US005520078A

United States Patent [19]

Hattori et al.

[11] Patent Number: 5,520,078

[45] Date of Patent: May 28, 1996

[54] HOLDING DEVICE FOR CUTTING AN OPHTHALMIC LENS

[75] Inventors: Kenshiro Hattori; Hiroyuki Oyama, both of Seki, Japan

[73] Assignee: Menicon Co., Ltd., Nagoya, Japan

[21] Appl. No.: 255,974

[22] Filed: Jun. 8, 1994

[30] Foreign Application Priority Data

Jun. 8, 1993 [JP] Japan ..... 5-163961

[51] Int. Cl.[6] ..... B23B 31/00; B23B 5/22

[52] U.S. Cl. ..... 82/165; 82/15; 279/5

[58] Field of Search ..... 82/165, 166, 167, 82/15; 451/379, 384, 385, 42; 279/202, 6, 132, 145, 5; 409/168

[56] References Cited

U.S. PATENT DOCUMENTS

| | | | |
|---|---|---|---|
| 2,456,776 | 12/1948 | Faust | 279/6 |
| 3,544,117 | 12/1970 | Bingham | 279/6 |
| 3,962,937 | 6/1976 | Miller | 82/165 |
| 4,277,916 | 7/1981 | Buhler . | |
| 5,195,407 | 3/1993 | Takeno et al. | 82/1.11 |

FOREIGN PATENT DOCUMENTS

| | | |
|---|---|---|
| 436940 | 4/1912 | France . |
| 3930503 | 3/1991 | Germany . |
| 1463508 | 2/1977 | United Kingdom . |

*Primary Examiner*—Maurina T. Rachuba
*Assistant Examiner*—Kenneth J. Hansen
*Attorney, Agent, or Firm*—Oblon, Spivak, McClelland, Maier & Neustadt

[57] ABSTRACT

A holding device for cutting an ophthalmic lens includes a holding member which has a spherical sliding surface. A support member is provided with a spherical receiving surface which slidably supports the spherical sliding surface of the holding member. In addition, a fixing assembly is provided for adjustably positioning the lens holding member with respect to the support member. The fixing assembly includes a guide member which is rotatable about a support center axis, with the guide member including an eccentric guide hole, such that pins disposed between the guide hole and an extension of the lens holding member move (or adjust the position of) the lens holding member in response to rotation of the guide member. Rotation of the guide member thus results in sliding movement of the lens holding member with respect to the support member to thereby position the holding member with respect to the support member. A jig can be associated with the lens holding member, with the jig including a spherical surface having a spherical center which coincides with the spherical center of the spherical sliding surface of the lens holding member.

6 Claims, 7 Drawing Sheets

HOLDING DEVICE FOR CUTTING AN OPHTHALMIC LENS

BACKGROUND OF THE INVENTION

1. Field of the Invention

The present invention relates to a holding device for cutting an ophthalmic lens, which is used for holding a lens workpiece when an ophthalmic lens is formed. More particularly, the present invention relates to a holding device for cutting an ophthalmic lens, which is capable of cutting easily an ophthalmic lens in which the optical center of an eyesight correction region is eccentric to the geometric center of the outer circumferential circle of the lens (i.e. a decentered ophthalmic lens).

2. Discussion of the Background

Generally, in an ophthalmic lens such as a contact lens, a lens put in an eyelid, the shape of the lens is determined so that the optical center of an eyesight correction region coincides with the geometric center of the outer circumferential circle of the lens. When the ophthalmic lens is finished, a lens supporting device is used wherein a lens workpiece is supported so that the center axis of the lens workpiece coincides with the center axis of cutting, and the lens workpiece is rotated around the center axis of the lens workpiece while the lens surface is finished by a cutting tool (cutting bit).

A study for an ophthalmic lens in recent years has revealed that in consideration of the shape of a cornea or the center position of a pupil, it is sometimes effective to deflect the optical center of the eyesight correction region from the geometric center of the outer circumferential circle of the lens.

For instance, when a contact lens is fitted to an eye, the lens is apt to move toward the ear because the radius of curvature of the front surface of the cornea is larger than the radius of curvature of a portion near the ear. Further, the center of the pupil is deflected toward the nose with respect to the center of the cornea. Accordingly, it is sometimes desirable that the optical center of the eyesight correction region should be slightly deflected toward the nose with respect to the geometric center of the outer circumferential circle of the lens.

However, in order to prepare a decentered ophthalmic lens with use of a conventional holding device for cutting, it was necessary to determine the position of the holding device by turning the entirety of the holding device so as to face the cutting tool. The position-determining operations was extremely difficult and was not practical.

Use of a non-spherical lens producing apparatus is proposed in U.S. Pat. No. 5,195,407 wherein control is made to a cutting tool so that the cutting tool is moved close to and away from a lens workpiece depending on a rotation angle of the lens workpiece which is rotated around the center axis of cutting, whereby a decentered ophthalmic lens can be finished. However, the proposed apparatus had problems that it was difficult to control for driving the cutting tool, and an increase of the rotation speed of the lens workpiece caused reduction in the accuracy of controlling the driving of the cutting tool. Thus, in the conventional apparatus, it was difficult to obtain both accuracy of processing and productivity.

SUMMARY OF THE INVENTION

It is an object of the present invention to provide a holding device for cutting an ophthalmic lens which is capable of easily cutting a decentered ophthalmic lens and optionally determining a decentered quantity for the ophthalmic lens.

It is another object of the present invention to provide a holding device for cutting an ophthalmic lens which allows cutting of a decentered ophthalmic lens with high processing accuracy and high productivity.

According to the present invention, there is provided a holding device for cutting an ophthalmic lens, which rotatably holds a lens workpiece around the center axis of cutting, with the device including a lens holding member having a spherical sliding surface to which the lens workpiece is fitted, a support member having a spherical receiving surface by which the spherical sliding surface of the lens holding member is supported slidably on the spherical receiving surface, and a fixing means for determining a position of sliding of the lens holding member with respect to the support member.

The fixing means of the holding device of the present invention including a position-determining extension formed in the lens holding member, a guide member having a guide hole whose center is eccentric to the support center axis of the holding device, with the guide member being rotatable around the support center axis which is in parallel to the center axis of cutting for a lens workpiece, and work pins which are disposed movably in the direction perpendicular to the support center axis, and each of which has an outer end in contact with the inner circumferential surface of the guide hole of the guide member and an inner end in contact with the position-determining extension of the lens holding member.

Further, in the holding device of the present invention, a balance hole is formed in the guide member at a position in symmetric with the guide hole with respect to the support center axis, and mass members are disposed in the guide member so as to be guided in the direction opposite the moving direction of the work pins by means of the inner circumferential surface of the balance hole.

In an aspect of the holding device of the present invention, the lens holding member is subjected to spherical-surface sliding on the support member and is fixed at an appropriate position whereby the center axis of the lens workpiece attached to the lens holding member is inclined to the center axis of cutting. Accordingly, the cutting center which is the optical center of the eyesight correction region is deflected from the center of the lens workpiece as the geometric center of the outer circumferential circle of the lens by a quantity corresponding to an inclination angle of the lens workpiece. Therefore, a decenter quantity corresponding to an amount of eccentricity can be determined by cutting the lens surface of the lens workpiece around the center axis of cutting.

In another aspect of the holding device of the present invention, when the guide member is rotated, the work pins are moved and a pushing force is exerted to the position-determining extension whereby the lens holding member is subjected to a spherical-surface sliding movement to thereby change the inclination angle of the lens workpiece. At the same time, the work pins are in contact to the position-determining extension whereby the position of the lens holding member, i.e., the lens workpiece is determined.

Further, in another aspect of the present invention, the movement of the mass is caused by the movement of the lens holding member and the work pins when the guide member is rotated. In the movement of the mass, mass members are moved in the opposite direction with respect to the support center axis.

DESCRIPTION OF THE PREFERRED EMBODIMENTS

The preferred embodiments of the present invention will now be described with reference to the drawings.

Figure 1:
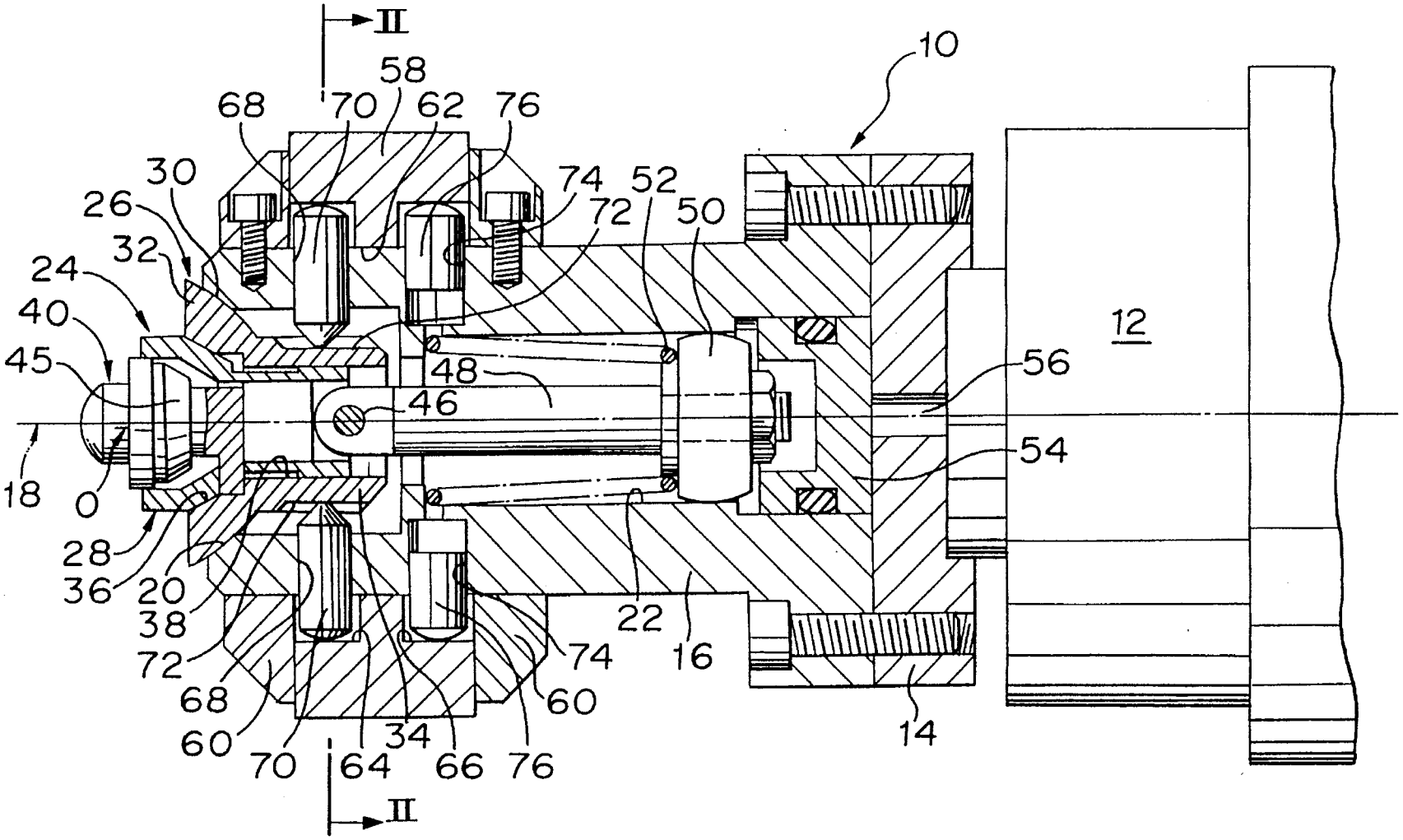
FIG. 1 is a longitudinal cross-sectional view of an important portion of an embodiment of the holding device for cutting an ophthalmic lens according to the present invention.
Figure 2:
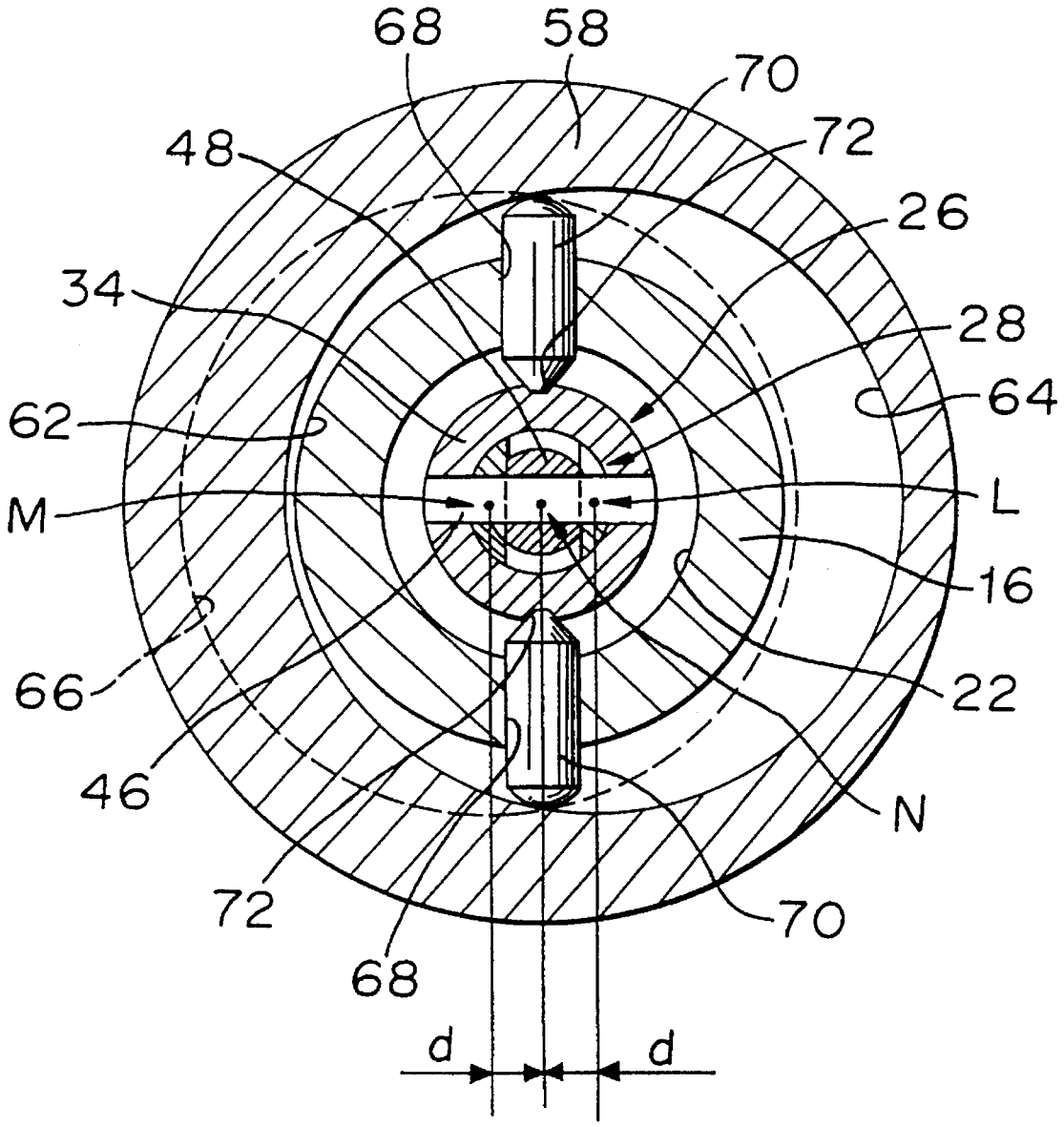
FIG. 2 is a cross-sectional view taken along a line II—II in FIG. 1.

FIGS. 1 and 2 show an embodiment of the holding device for cutting an ophthalmic lens according to the present invention.

Numeral 10 designates a holding device for cutting which has a main shaft 12 rotated around the center axis by a driving means such as a motor (not shown).

A support member 16 is firmly connected to an end portion of the main shaft 12 by interposing a connecting plate 14. The support member 16 is in a substantially cylindrical shape as a whole, and is connected to the connecting plate 14 by means of bolts at a rear end portion in the axial direction (a right end portion in FIG. 1) so that the support center axis 18 as the center axis of the support member 16 is coaxial with the rotation center axis of the main shaft 12 as the center axis of cutting.

A spherical recessed surface 20 as a receiving surface is formed at an end of an opening in front of and in the axial direction of the support member 16. The spherical recessed surface 20 is a spherical surface having the center at a point O on the support center axis 18.

From the opening which is in front of and in the axial direction of the support member 16, a part of a lens holding member 24 which is constituted by a sliding collar 26 and a collet chuck 28 is inserted in an inner bore 22 of the support member 16.

The sliding collar 26 has a substantially cylindrical shape as a whole, and at a side in the axial direction of it (the left end portion in FIG. 1), has a sliding portion 32 which has a spherical projection surface 30 as a sliding surface in the outer circumferential surface.

Further, the sliding collar 26 has a tapered portion 36 which outwardly flared at an inner circumferential portion of the opening at the side of the sliding portion 32. The spherical projection surface 30 of the sliding portion 32 has substantially the same radius of sphere as the spherical recessed surface 20 of the support member 16. Further, the sliding collar has a cylindrical portion 34 as a position-determining extension at the other end of the axial direction.

The collet chuck 28 is inserted in the inner bore 38 of the sliding collar 26 so that it is movable in the axial direction. When the collet chuck 28 is pulled in the inner bore 38, a shrinking force is exerted to the tapered surface 36 to grip a jig 40. The collet chuck 28 holds therein a support table 45 for receiving and position-determining the bottom surface of the jig 40.

Figure 3:
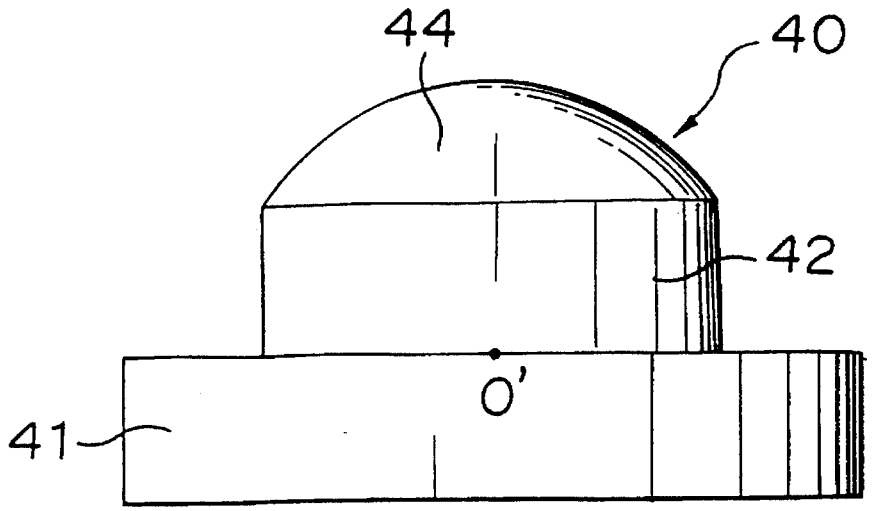
FIG. 3 is a side view of a jig used for the holding device shown in FIG. 1.

As shown in FIG. 3, the jig 40 is so constructed that a column-like supporting portion 42 projects from a circular plate-like base portion 41. The free end portion of the support member 42 is formed to have a spherical surface 44, the spherical shape of which substantially correspond to the shape of a lens surface of an ophthalmic lens to be produced. Then, a lens workpiece (not shown) is fitted to the spherical surface 44 with the completely finished lens surface in contact with the spherical surface 44. The dimensions of the jig 40 are so determined that when the jig 40 is pulled into the inner bore 38 of the sliding collar 26 and is gripped by the collet chuck 28, the center O' of the spherical surface 44 coincides with the center of the spherical projection surface 30 of the sliding portion 32 of the sliding collar 26.

The lens holding member 24, comprising the sliding collar 26 and the collet chuck 28, is inserted in the inner bore of the support member 16 from the side of the cylindrical portion 34 of the sliding collar 26, and the spherical projection surface 30 of the sliding portion 32 of the sliding collar 26 is in contact with the spherical recessed surface 20 of the support member 16 in a manner capable of spherical-surface sliding. Namely, since spherical surface sliding is permitted between the spherical recessed surface 20 and the spherical projection surface 30, the lens holding member 24 is supported rotatable around the center O on the support center axis 18, whereby the lens workpiece attached to the jig 40 can be moved around the center of the spherical surface.

The operation rod 48 is connected to the rear end portion of the sliding collar 26 and the collet chuck 28 by means of an engaging pin 46 which penetrates the sliding collar 26 and the collet chuck 28 in the direction perpendicular to the center axis of these elements so that the operation rod 48 is capable of swinging around the engaging pin 46. An engaging hole for the engaging pin 46, which is formed in the sliding collar 26, is an elongated hole. Accordingly, the collet chuck 28 is shiftable in its axial direction with respect to the sliding collar 26.

A sliding metal piece 50 which is disposed in the inner bore 22 of the support member 16 slidably in the axial direction is fixed to the rear end portion of the operation rod 48 by means of a bolt. A coil spring 52 is also disposed in the inner bore 22 of the support member 16 so that a force is exerted backwardly to the sliding collar 26 and the collet chuck 28 through the sliding metal piece 50 and the operation rod 48. With such arrangement, when the sliding collar 26 is pulled into the inner bore 22 of the support member 16 and the spherical projection surface is brought into contact with the spherical recessed surface 20 of the support member 16, the lens holding member 24 is held so as to be capable of spherical surface sliding around the center O, and the jig 40 on which the lens workpiece is fitted is gripped by the collet chuck by pulling the collet chuck 28 into the inner bore 38 of the sliding collar 26. Further, a piston 54 is disposed behind the sliding metal piece 50 in the rear portion of the inner bore 22 of the support member 16. An air feeding passage 56 for driving the piston is formed in the connecting plate 14. When the piston 54 is driven forwardly, the piston 54 fits the sliding metal piece 50 so that a pushing force is forwardly exerted to the collet chuck 28 by means of the operation rod 46. Thus, the jig 40 is ready to remove.

A generally ring-shaped guide member 58 is fitted to a side portion of the front part of the outer circumferential surface of the support member 16, and position-determining rings 60, 60 are disposed at both sides in the axial direction of the guide member 58. The guide member 58 has stepped portions in the axial direction in its inner bore, and has a position-determining opening 62 having substantially the same inner diameter as the outer diameter of the support member 16 at its central portion. On the other hand, a guide hole 64 and a balance hole 66 each having a larger diameter than the position-determining opening 62 are formed in the both side portions in the axial direction of the guide member 58. As shown in FIG. 2, the center axis L of the guide hole 64 and the center axis M of the balance hole 66 are determined at eccentric positions in opposite directions with respect to the center axis N of the position-determining opening 62.

In this embodiment, the guide hole 64 and the balance hole 66 are respectively circular in shape, and an eccentric distance d of the center axis L of the guide hole 64 and an eccentric distance d of the center axis M of the balance hole 66 with respect to the center axis N of the position-determining opening 62 are determined to be the same, whereby a good balance in the weight of the guide member 58 itself around the center axis can be obtained.

Since the position-determining opening 62 of the guide member 58 is fitted slidably to the outer circumferential surface of the support member 16, the center axis N of the position-determining opening 62 is made coincident with the support center axis 18 of the support member 16, whereby the guide member 58 is rotatable around the support center axis 18 of the support member 16.

A pair of insertion openings 68, 68 are formed in the support member 16 at positions facing the inner circumferential surface of the guide hole 64 of the guide member 58 and in the direction extending radially from the support center axis 18. Work pins 70, 70 are disposed in the insertion openings 68, 68 so as to be shiftable in the radial direction. The outer end portion of each of the work pins 70 is brought into contact with the inner circumferential surface of the guide hole 64 of the guide member 58 to thereby restrict an amount of projection of the work pins 70 from the support member 16. On the other hand, the inner end portion of each of the work pins 70 is brought into contact with the outer circumferential surface of the cylindrical portion 34 of the sliding collar 26. A pair of longitudinal grooves 72 are formed in the cylindrical portion 34 of the sliding collar 26 so as to extend in the axial direction, and the inner end portion of each of the work pins 70 is sharpened and rests in the longitudinal grooves 72.

Figure 4:
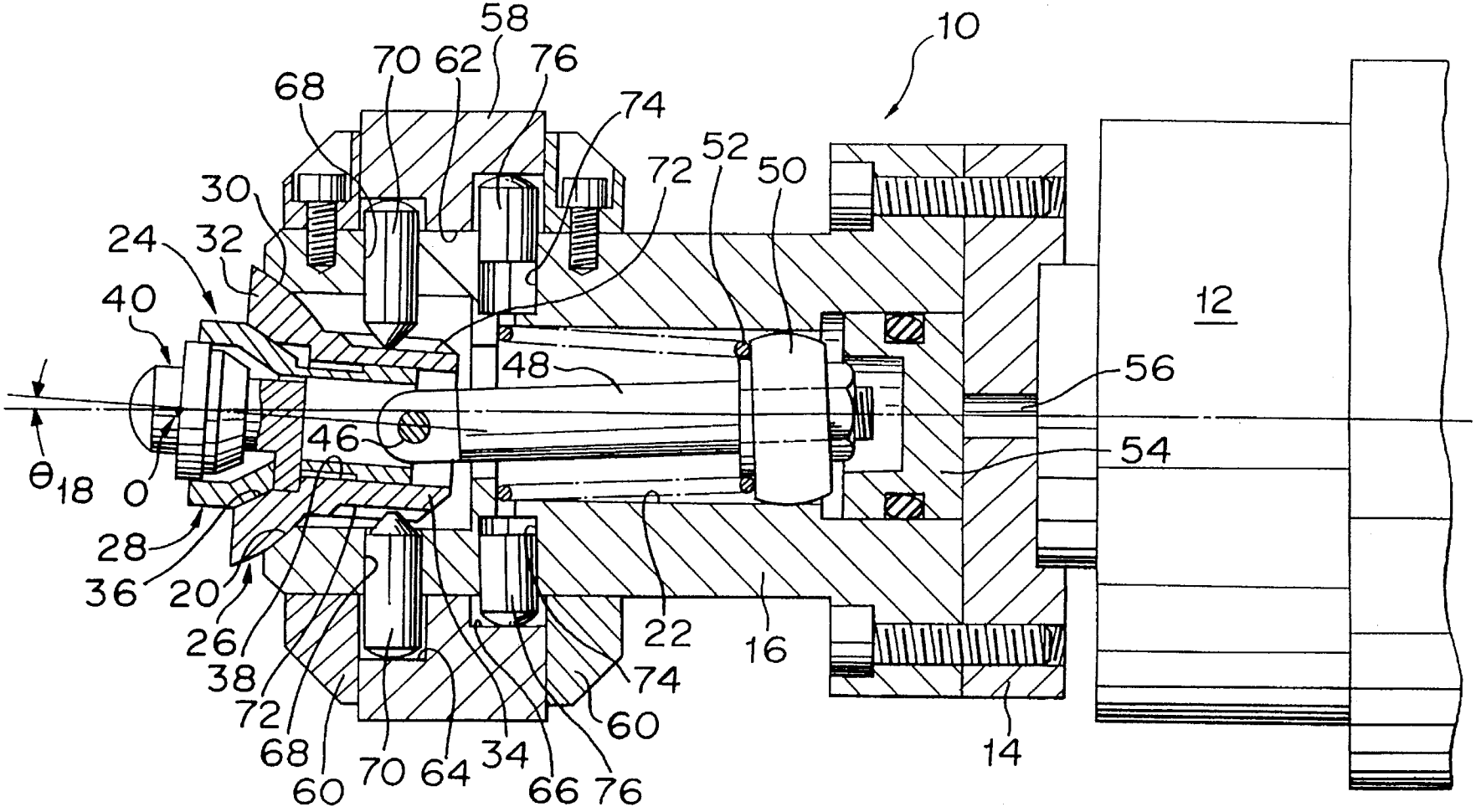
FIG. 4 is a longitudinal cross-sectional view showing a state of operation of the holding device shown in FIG. 1.

With such arrangement, the position of the cylindrical portion 34 of the sliding collar 26 is determined by the work pins 70, 70, whereby the lens holding member 24, i.e., the lens workpiece can be kept at a predetermined position. As shown in FIG. 4, when the guide member 58 is rotated around the support member 16, the work pins 70, 70 are moved in the direction perpendicular to the support center axis 18 because the outer end portion of the work pins 70, 70 is pushed by the inner circumferential surface of the guide hole 64. Then, the cylindrical portion 34 of the sliding collar 26 is pushed upwardly or downwardly whereby the lens holding member 24, i.e., the lens workpiece is turned around the center O.

In this embodiment, since the circular guide hole 64 having an eccentric quantity d with respect to the support center axis 18 is formed, there is a possibility that a clearance may take place between either of the work pins 70 and the cylindrical portion 34 of the sliding collar 26 depending on a rotational position of the guide member 58. In this case, however, the sliding collar 26 can be kept at an appropriate position by the contact with the other work pin 70 by means of the pushing force of the coil spring 52. On the other hand, the work pin 70 which is not brought to contact with the cylindrical portion 34 of the sliding collar 26 is kept at a projecting position, which is restricted by the inner circumferential surface of the guide hole 64 of the guide member 58, by a centrifugal force when the main shaft 12 is rotated.

Further, a pair of mass receiving openings 74, 74 are formed in the support member 16 at positions facing the inner circumferential surface of the balance hole 66 of the guide member 58. Each of the mass receiving openings 74, 74 has a predetermined depth., and the center axis of the mass receiving openings is in parallel to the center axis of the insertion openings 68, 68 for the work pins 70, 70. Mass members 76 each having a cylindrical form are slidably inserted in the mass receiving openings 74, 74. An outer end portion of each of the mass members 76 is brought to contact with the inner circumferential surface of the balance hole 66 of the guide member 58 so that a projection quantity of the mass members 76 with respect to the support member 16 can be restricted. Namely, when the main shaft 12 is rotated, each of the mass members 76 can be kept at a projecting position by means of a centrifugal force, which is restricted by the inner circumferential surface of the balance hole 16 of the guide member 58.

Further, since the balance hole 66 is deflected with an eccentric quantity d in the direction opposite the guide hole 64 with respect to the support center axis 18, a projection quantity of each of the mass members 76, 76 which is restricted by the inner circumferential surface of the balance hole is changed when the guide member 58 is rotated around the support member 16. As a result, the mass members 76, 76 are moved in the direction opposite the movement of the work pins 70, 70 and the cylindrical portion 34 of the sliding collar 26.

Figure 5:
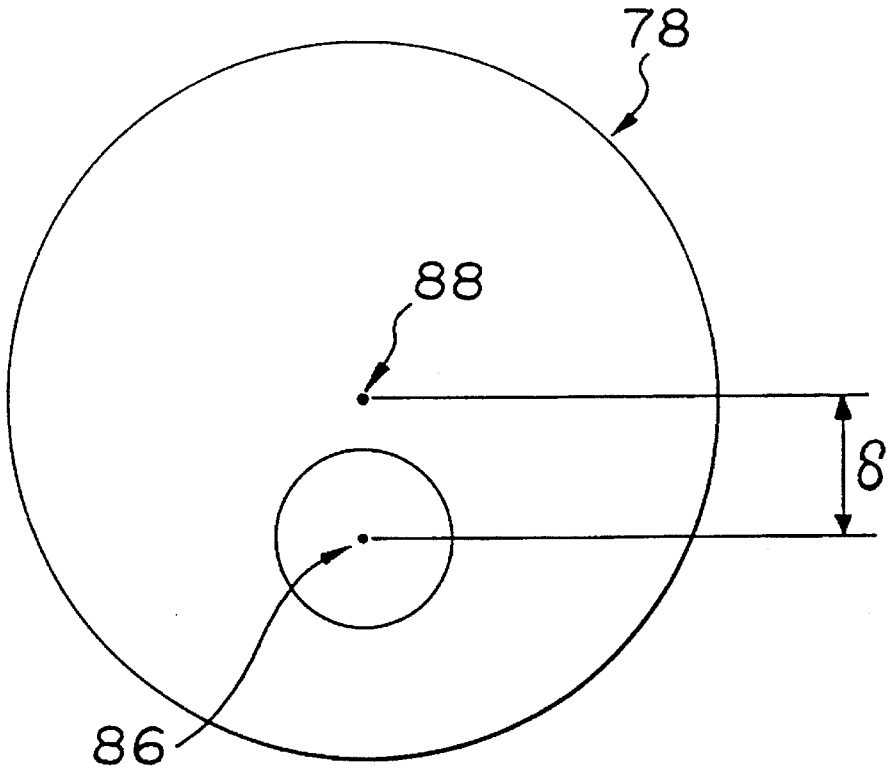
FIG. 5 is a front view of an example of an ophthalmic lens finished by using the holding device shown in FIG. 1.
Figure 6:
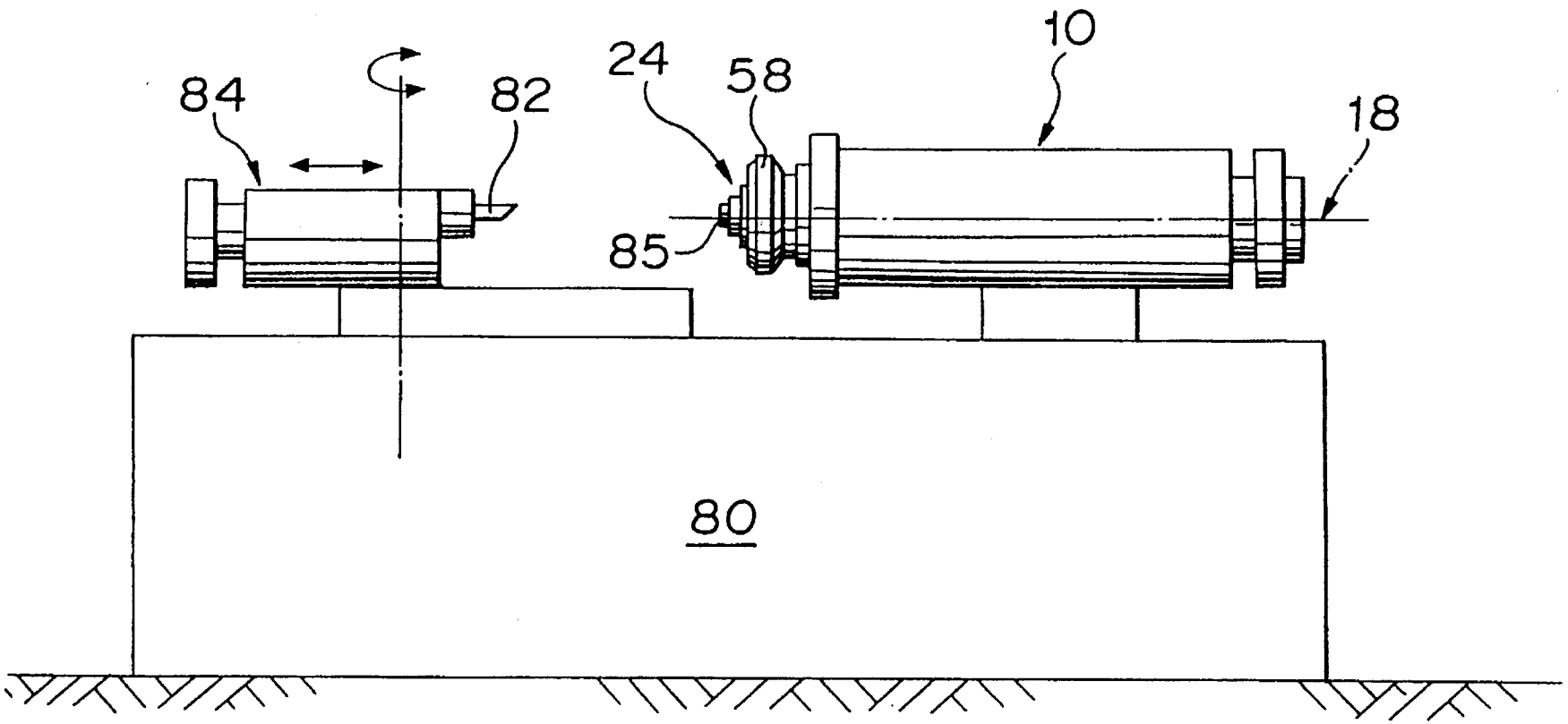
FIG. 6 is a schematic view of a processing apparatus for explaining cutting operations with use of the holding device shown in FIG. 1.

When an ophthalmic lens 78 having a decenter quantity δ (as shown in FIG. 5) is processed for cutting with use of the holding apparatus for cutting 10 having the above-mentioned construction, the holding device for cutting 10 is first mounted on a table 80, and then, a cutting device 84 with a cutting tool 82 is arranged so as to oppose the holding device for cutting 10 as shown in FIG. 6. In this embodiment, the cutting device 84 is disposed on the table 80 in a manner of capable of swinging around a vertical axis and is capable of approaching and going away from the holding device for cutting 10 in the horizontal direction.

Then, a lens workpiece 85 having an inner surface which has been processed to have the final shape to be obtained, is bonded to the spherical surface 44 onto which a lens is to be attached, of the jig 40. The jig 40 is gripped with the collet chuck 28 of the holding device for cutting 10 (FIG. 1).

Then, the guide member 58 is turned to a predetermined position on the support member 16, and the work pins 70 are moved so that the lens holding member 24 is moved to a predetermined position, as shown in FIG. 4. Thus, the center axis of the jig 40, i.e. the lens workpiece 85 is inclined by an angle θ with respect to the support center axis 18. The inclination angle θ is so determined as to provide the decenter quantity θ to be set for the ophthalmic lens 78. Namely, the inclination angle θ is so determined that the distance between the support center axis 18 and the center axis of the lens workpiece is δ on the surface of the lens.

When the guide member 58 is rotated, the position of each of the mass members 76 in an amount of projection which is restricted by the balance hole 66 is shifted oppositely to the work pins 70 and the lens holding member 24. In other words, when the amount of projection of the mass members 76 is changed, imbalance in rotation of the holding device for cutting 10 with respect to the support center axis 18, which is caused by the movement of the work pins 70 and the lens holding member 24 can be absorbed or eliminated. More specifically, the mass of the mass members 76 is so determined that a change in an amount of projection of the mass members 76 absorbs ununiformity of the balance of rotation of the holding device for cutting 10 with respect to the support center axis 18, which is caused by the movement of the work pins 70 and the lens holding member 24.

The main shaft of the holding device for cutting 10 is rotated by a rotation driving means (not shown) so that the lens workpiece is rotated around the support center axis 18. Then, the outer surface of the lens workpiece is processed for cutting by means of the cutting tool 82 attached to the cutting device 84 (FIG. 6).

In the cutting operations, the lens workpiece is processed around the support center axis 18 as the cutting center axis. As a result, a desired ophthalmic lens as shown in FIG. 5 is obtainable wherein there is, on the lens surface, a decenter quantity δ between the optical center axis 86 and the geometric center axis 88 of the outer diameter of the lens.

Thus, the holding device for cutting 10 is so constructed that the center axis 88 of the lens workpiece can be inclined to the cutting center axis (the support center axis 18) without moving the device itself and by changing only the position of the lens holding member 24, whereby a decentered ophthalmic lens can be easily processed for cutting.

Further, an inclination angle of the lens workpiece to the cutting center axis can be changed by subjecting the lens holding member 24 to spherical sliding with respect to the support member 16. Accordingly, a decenter quantity can be easily determined or changed.

Further, since the sliding surface of the lens holding member 24, which is in contact with the support member 16, is formed to have a spherical surface, the centering operation for the lens holding member 24, hence, the lens workpiece can be easy, and highly accurate position-determination is possible.

In the holding device for cutting 10, a decentered ophthalmic lens can be processed for cutting by moving the cutting tool 82 on the cutting device 84 to the lens workpiece depending on an angle of turning, and it is unnecessary to effect reciprocal movements of the cutting tool depending on an angle of rotation around the cutting center axis of the lens workpiece. Accordingly, control for the device can be easy. Further, both accuracy in processing and productivity can be simultaneously obtained when a speed of rotating of the lens workpiece is increased.

In the embodiment of the present invention, the guide hole 64 is formed to have a circular shape. However, when the eccentric quantity of the optical center of a lens to the geometric center is to be adjusted slightly at a portion near the geometric center of the lens, it is possible to use a non-circular hole such as a elliptic hole so that a rate of change of the inclination angle θ of the lens workpiece 85 with respect to an amount of rotation of the guide member 58 is reduced.

Further, a desired balance of rotation can be obtained by forming a balance hole having a shape in symmetric with the shape of a guide hole with respect to the center axis N.

Further, an advantage of the holding device for cutting 10 in this embodiment is that the determination of the decenter quantity is further easy because the inclination angle θ of the lens workpiece is determined depending on a position of rotation of the guide member 58. Since the holding device for cutting 10 in this embodiment is so constructed that ununiformity of the balance of rotation which is caused by a change of the position of the mass members 76 during the rotation of the guide member 58 and the movement of the work pins 70 and so on in the determination of the decenter quantity, can be automatically corrected. Accordingly, operations for balancing are unnecessary, and reduction in accuracy for processing due to the vibrations of the elements caused by the ununiformity of balance of rotation can be effectively eliminated.

Further, in the holding device for cutting 10 in this embodiment, since the center O' of the spherical surface 44, onto which a lens is to be attached, of the jig 40 is made in coincidence with the center O of the sliding movement of the lens holding member 24, a prism eccentricity in the decentering direction in the determination of a decenter quantity can be eliminated, and design for a lens surface can be easy.

As described above, an embodiment of the holding device for cutting of the present invention has been described. However, the present invention should not be limited to the above-mentioned embodiment.

Figure 7:
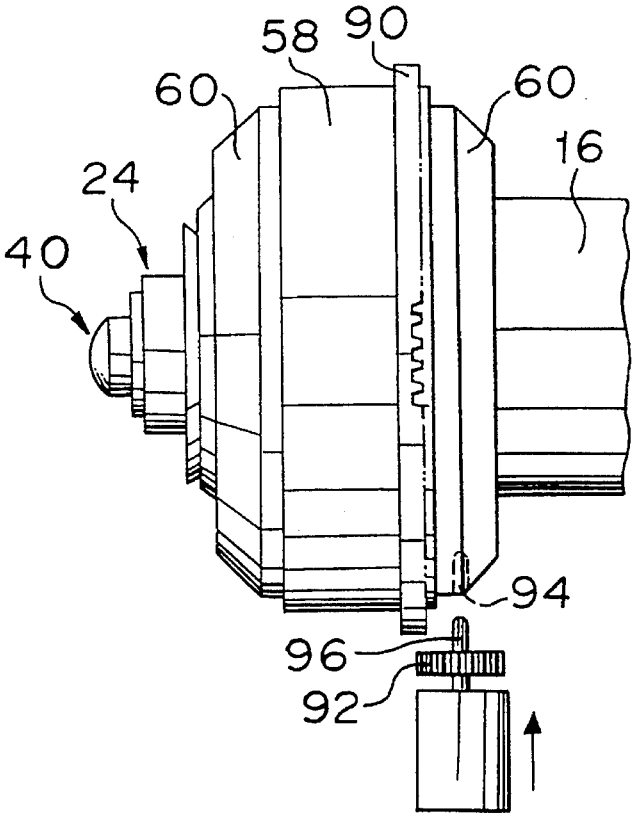
FIG. 7 is a diagram showing an important portion of another embodiment of the holding device of the present invention.

For instance, as shown in FIG. 7, a ring gear wheel 90 may be fixed to the outer circumferential surface of the guide member 58, and a small gear wheel 92 driven by a motor may be engaged with the ring gear wheel 90, whereby the guide member 58 is automatically rotated.

In the rotation of the guide member 58, it is desirable to prevent the rotation of the support center axis 18 along with the rotation of the guide member 58 by providing a stop opening 94 in a position-determining ring 60 and by inserting a motor shaft 96 into the stop opening 94.

In the embodiment mentioned before, the support member 16 is fixed to the main shaft 12, and the support center axis 18 of the support member 16 is made in coincidence with the cutting center axis. However, an eccentric mechanism may be disposed onto the main shaft 12 of the support member 16 so that the support center axis 18 is deflected from the cutting center axis. With such eccentric mechanism, it is possible to cut an ophthalmic lens having a prism ballast structure as shown in FIG. 8 wherein the center axis in the inner surface of the lens is deflected by a prism quantity γ from the center axis of the outer surface in the direction perpendicular to the decentering direction.

Figure 9:
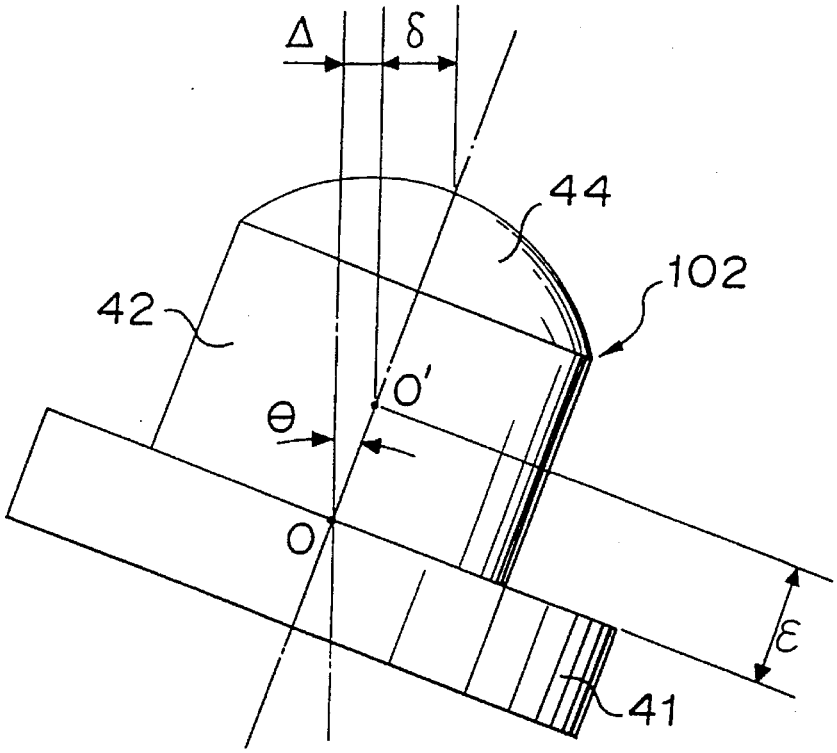
FIG. 9 is a side view showing another embodiment of the jig used for the holding device of the present invention.

Further, a jig 102 as shown in FIG. 9 may be used wherein a supporting portion 42 is elongated and the center O' of a spherical surface 44 onto which a lens is to be attached is determined at a position apart by a predetermined quantity ε from the center O of the sliding movement of the lens holding member 24 on the center axis of the lens workpiece. With use of the jig 102, a prism eccentricity can be produced in the lens workpiece attached to the spherical surface 44 onto which the lens is to be attached, by a quantity Δ in the decentering direction, in correspondence to an inclination angle θ to the support center axis 18. Accordingly, as shown in FIG. 10, for instance, when the support center axis 18 of the support member 16 is deflected by a prism quantity γ in the direction perpendicular to the centering direction with respect to the cutting center axis, and when the prism quantity Δ is determined in the decentering direction by means of the jig 102, it is possible to determine a prism quantity in an amount combining γ and Δ.

Figure 8:
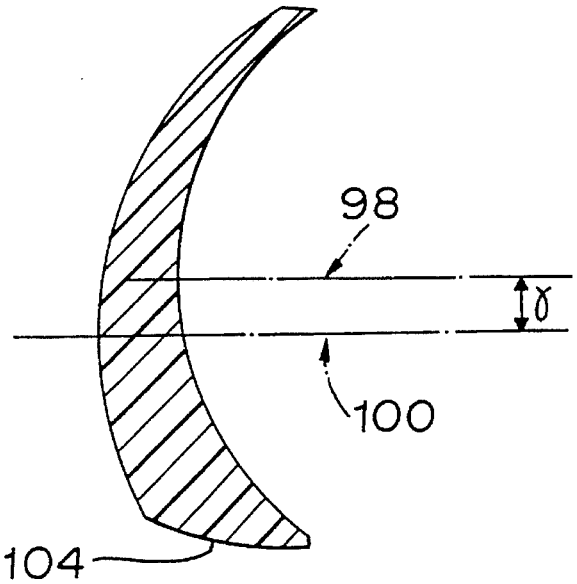
FIG. 8 is a cross-sectional view showing an example of an ophthalmic lens finished by using the holding device of the present invention.
Figure 10:
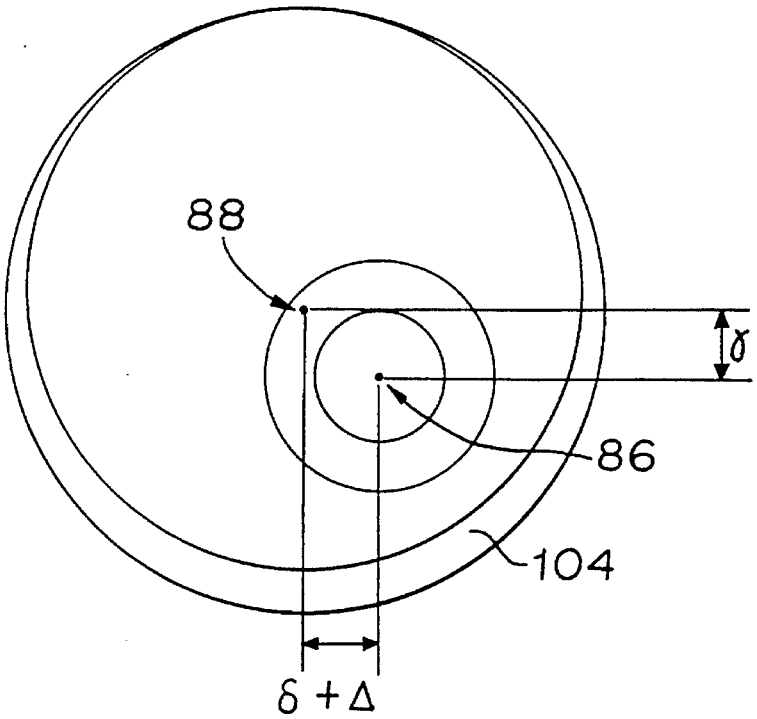
FIG. 10 is a cross-sectional view showing an example of an ophthalmic lens finished by the jig shown in FIG. 9.

Further, as shown in FIGS. 8 and 10, when a prism eccentric quantity is determined for a contact lens, a slab-off region 104 is generally formed wherein the outer circumferential portion of a lens which does not have an eyesight correcting function is cut in a spherical shape having the center on the geometric center axis of the lens outer circumferential circle, whereby an excellent feeling of fitting is assured. The formation of the slab-off region 104 can be effectively formed by rotating the lens holding member 24, before and after the cutting of the central portion of the lens, and by cutting the outer circumferential portion in a state that the center axis of the lens workpiece is made in coincidence with the cutting center axis.

The embodiment described above concerns a case of forming the spherical projection surface 44 of the jig 40 onto which a lens is attached and cutting the outer surface of the lens. However, the holding device for cutting according to the present invention can be applied to a case that a decenter quantity is formed by cutting the inner surface of the lens..

The means for holding the lens workpiece is not always the collet chuck, but any means to detachably hold the lens workpiece maybe used.

In the embodiment described above, the coil spring 52 is used to exert a pushing force to the sliding collar 26 through the operation rod 48 so that the sliding collar 26 can be held slidably at the spherical surface and the position of rotation of the sliding collar 26. However, any pushing means may be used as far as it allows a sliding movement at the spherical surface of the sliding collar 26 and it pushes the sliding collar 26 backwardly.

However, it is not always necessary to use such pushing means for exerting a pushing force to the sliding collar 26 if a sliding surface structure wherein the movement of the sliding collar 26 to the support member 16 in its axial direction can be prevented is employed, and the position of rotation of the sliding collar 26 is fixed by means of a volt or the like.

Further, it is not always necessary that the fixing means for determining the position of the sliding collar 26 with respect to the support member 16 is constituted by the guide member 58 and the work pins 70 as described above. For instance, the position of rotation of the sliding collar 26 may be determined by using a pair of screws instead of the work pins and by adjusting an amount of engaging the screws.

Further, the mass members 76, 76 to obtain the balance of rotation can be eliminated. For instance, the balance of rotation can be obtained by attaching an appropriate weight to the support member 16 or the main shaft 12 instead of using the mass members.

As described above, in accordance with the holding device for cutting an ophthalmic lens according to the present invention, a decentered ophthalmic lens can be cut by sliding the lens holding member on a spherical surface of the support member, and by inclining the center axis of the lens workpiece to the cutting center axis without moving the entirety of the holding apparatus. Further, the ophthalmic lens can be easily cut with a predetermined decenter quantity by adjusting the position of sliding of the lens holding member with respect to the support member, and determining optionally the decenter quantity.

Further, the holding device for cutting an ophthalmic lens of the present invention uses the optical center axis of an eyesight correction region as the cutting center axis. Accordingly, it is unnecessary to move reciprocately a cutting tool depending on an angle of rotation of the lens workpiece; control for the device can be easy, and a speed of rotation of the lens workpiece can be increased while keeping accuracy of processing by the cutting tool. Accordingly, the accuracy of processing and productivity can be simultaneously obtained.

In an aspect of the present invention, an inclination angle of the lens workpiece can be determined depending on the position of rotation of the guide member. Accordingly, a decenter quantity can be determined by rotating the guide member, whereby operations for the determination of the decenter quantity can be further simple.

Further, in an aspect of the present invention, ununiformity of the balance in weight due to the movement of the lens holding member and the work pins can be reduced or eliminated by the movement of the mass members. Accordingly, the balance of rotation during the cutting operations is automatically maintained; an improvement in workability is obtainable, and reduction in the accuracy of processing due to vibrations which are caused by the ununiformity of the balance of the constituting elements can be effectively eliminated.

It is understood that the present invention can be carried out based on various modification, alterations and improvements, which are included in the present invention.

We claim:

1. A holding device for cutting an ophthalmic lens, which holds a lens workpiece rotatable around a center axis of cutting, the holding device comprising:

a lens holding member having a spherical sliding surface, a support member having a spherical receiving surface by which the spherical sliding surface of the lens holding member is supported slidably on the spherical receiving surface, and a fixing means for adjustably positioning the lens holding member with respect to the support member, said fixing means comprising:

(a) a position-determining extension formed in the lens holding member, (b) a guide member having a guide hole having an inner circumferential surface, said guide hole having a center which is eccentric to a support center axis of the holding device, the guide member being rotatable around the support center axis which is parallel to the center axis of cutting, and (c) work pins which are movably disposed in a direction perpendicular to the support center axis, add each of which has an outer end in contact with the inner circumferential surface of the guide hole of the guide member and an inner end in contact with the position-determining extension of the lens holding member.

2. The holding device according to claim 1, wherein a balance hole is formed in the guide member at a position such that the balance hole is symmetrically disposed with respect to the guide hole about the support center axis, and mass members are disposed in the guide member so as to be guided in directions opposite the moving direction of the work pins by means of the inner circumferential surface of the balance hole.

3. The holding device of claim 1, further including:

a sliding piece slidably disposed in said support member; and a rod having first and second ends, said first end connected to said sliding piece, and said second end connected to said lens holding member.

4. The holding device of claim 3, wherein said second end of said rod is pivotally connected to said lens holding member.

5. The holding device of claim 4, wherein the lens holding member includes a sliding collar and a collet chuck, and wherein said spherical sliding surface is disposed on said sliding collar, and wherein said collet chuck is axially movable with respect to said sliding collar, and further wherein said rod is pivotally connected to each of said sliding collar and said collet chuck.

6. The holding device of claim 5, wherein said collet chuck includes a support table, the holding device further including a jig, said jig including a spherical surface and a base, and wherein said collet chuck holds said jig with said base adjacent to said support table and with a spherical center of the spherical surface of the jig coinciding with a spherical center of the spherical sliding surface.

* * * * *